US005120043A

United States Patent [19]

Marzullo

[11] Patent Number: 5,120,043

[45] Date of Patent: Jun. 9, 1992

[54] JAM CLEARING AND DAILY MAIL DEVICE FOR A DOCUMENT FEEDER

[75] Inventor: Joseph A. Marzullo, Brookfield, Conn.

[73] Assignee: Pitney Bowes Inc., Stamford, Conn.

[21] Appl. No.: 615,561

[22] Filed: Nov. 19, 1990

[51] Int. Cl.[5] ..... B65H 3/06

[52] U.S. Cl. ..... 271/117; 271/119; 271/124; 414/797.7

[58] Field of Search ..... 271/117, 119, 121, 124, 271/125, 274; 221/277; 414/797.7

[56] References Cited

U.S. PATENT DOCUMENTS

| | | | |
|---|---|---|---|
| 4,585,218 | 4/1986 | Williams et al. | 414/797.7 |
| 4,641,830 | 2/1987 | Okuda et al. | 271/274 |
| 4,850,580 | 7/1989 | Denzin et al. | 271/121 X |
| 4,925,062 | 5/1990 | Tsukamoto et al. | 271/121 X |
| 4,966,358 | 10/1990 | Yokoi et al. | 271/117 X |

FOREIGN PATENT DOCUMENTS

| | | | |
|---|---|---|---|
| 0098540 | 4/1989 | Japan | 271/274 |

*Primary Examiner*—H. Grant Skaggs

*Assistant Examiner*—Carol Lynn Druzbick

*Attorney, Agent, or Firm*—Charles R. Malandra, Jr.; David E. Pitchenik; Melvin J. Scolnick

[57] ABSTRACT

The present invention is embodied in a document feeder of an inserting machine. The feeder comprises a frame, a feed deck coupled to the frame, a separator wheel assembly for separating and feeding individual documents. The separator assembly includes a separator wheel disposed above the feed deck and a drive for the separator wheel. The separator wheel assembly can be adjusted to a position relative to the feed deck commensurate with the material being fed. The improvement comprises the separator wheel assembly being biased against a cam. The cam is located above the separator wheel assembly, wherein the separator wheel assembly is in a first position for singulating and feeding sheets when the cam is in a normal position, and wherein the separator wheel assembly raises to a second position when the cam is rotated to an eccentric position, whereby the singulating and feeding of individual documents is prevented when the separator wheel assembly is in the second position.

10 Claims, 2 Drawing Sheets

JAM CLEARING AND DAILY MAIL DEVICE FOR A DOCUMENT FEEDER

RELATED APPLICATIONS

The following related applications refer to the subject matter of this application:

U.S. application Ser. No. 07/616,263, filed Nov. 20, 1990

U.S. application Ser. No. 07/617,238, filed Nov. 21, 1990

FIELD OF INVENTION

This invention relates to document feeders, and in particular to a document feeder with a separator wheel assembly in an inserter machine.

BACKGROUND OF THE INVENTION

In the art of feeding documents, it is known to use a separator wheel assembly in a document feeder for separating and feeding individual sheets from a stack of sheets. One type of separator, known as an interference type separator includes a separator wheel which operates in cooperation with a separator stone extending through the feed deck for performing the separating task. Generally, in an interference type separator, the separator wheel includes a plurality of angular grooves into which a plurality of inclined raised members, commonly referred to as fingers, of the separator stone protrude. The documents are fed through the bite between the separator wheel and the separator stone with the fingers of the stone operating in cooperation with the grooves in the feed roller. An example of such an interference type separator is shown in U.S. Pat. No. 4,501,417, issued Feb. 26, 1985 to Dean H. Foster and assigned to the assignee of the present invention.

The nature of separator assemblies, and in the particular with the interference type separator, is that an adjustment must be made to the spaced relationship or "bite" between the separator wheel and the separator stone whenever there is a change in documents to be fed. Typically, the bite between the separator wheel and the separator stone is adjustable for the purpose of feeding documents of various thicknesses. The adjustment once made is locked into place until documents of other thicknesses are to be fed.

Generally, when a paper jam occurs at the separator assembly, the jam cannot be cleared without some damage to the jammed sheet. The most reliable way for clearing jams at the separator assembly is through the feed path downstream from the separator assembly. However, in many instances this may require the removal of a machine cover over the downstream feed path, and may require reaching into the rollers and belts in the feed path to retrieve the jammed sheet. Even in this instance, the sheet may be damaged because of the interference relationship of the stone fingers and the separator wheel.

As previously stated, the interference type separator assembly has an adjustment which is locked into one position for feeding the particular documents being fed at that time. Currently, there is no device that would perform the singulating feeding of sheets which can also be used to feed multiple sheets without requiring a new adjustment for subsequent documents as originally fed.

In U.S. Pat. No. 4,775,140 issued Oct. 4, 1988 to Dean H. Foster and assigned to the assignee of the present invention, there is shown an envelope feeder including a second frame assembly which can be pivotally raised to provide access for clearing a jam. However, this feeder is a gap type feeder which does not require the sensitive adjustment typically required in interference type feeders. After the jam is cleared, the second frame is returned to its original position. The feeding operation is interrupted while the second frame is in the raised position.

SUMMARY OF THE INVENTION

It has been discovered that jam clearing is simplified and rendered less likely to damage the jammed sheets, by raising the separator wheel assembly so that the gap between the separator wheel assembly and the separator stone is suitable for retrieving the jammed sheet from either direction. It has been found this can be achieved by using an eccentric cam against which a spring biased separator wheel assembly rests. The separator wheel assembly can be raised for jam clearing and then returned to its adjusted position without the need for further adjustment. It has also been discovered that, when the separator wheel assembly is in the raised position, the feeding operation is available for manually feeding single or multiple sheets as desired.

The present invention is embodied in a document feeder of an inserting machine. The feeder comprises a frame, a feed deck coupled to the frame, a separator wheel assembly for separating and feeding individual documents, the separator assembly including a separator wheel disposed above the feed deck, means for driving the separator wheel, and means for adjustably positioning the separator wheel assembly to a position relative to the feed deck commensurate with the material being fed. The improvement comprises means for biasing the separator wheel assembly against a cam. The cam is located above the separator wheel assembly, wherein the separator wheel assembly is in a first position for singulating and feeding sheets when the cam is in a normal position, and wherein the separator wheel assembly raises to a second position when the cam is rotated to a low eccentric position, whereby the singulating and feeding of individual documents is interrupted.

BRIEF DESCRIPTION OF THE DRAWINGS

Further features and advantages of the apparatus in accordance with the invention will be clearly seen and more easily understood from the description of the figures wherein.

DETAILED DESCRIPTION OF THE PREFERRED EMBODIMENT

Figure 1:
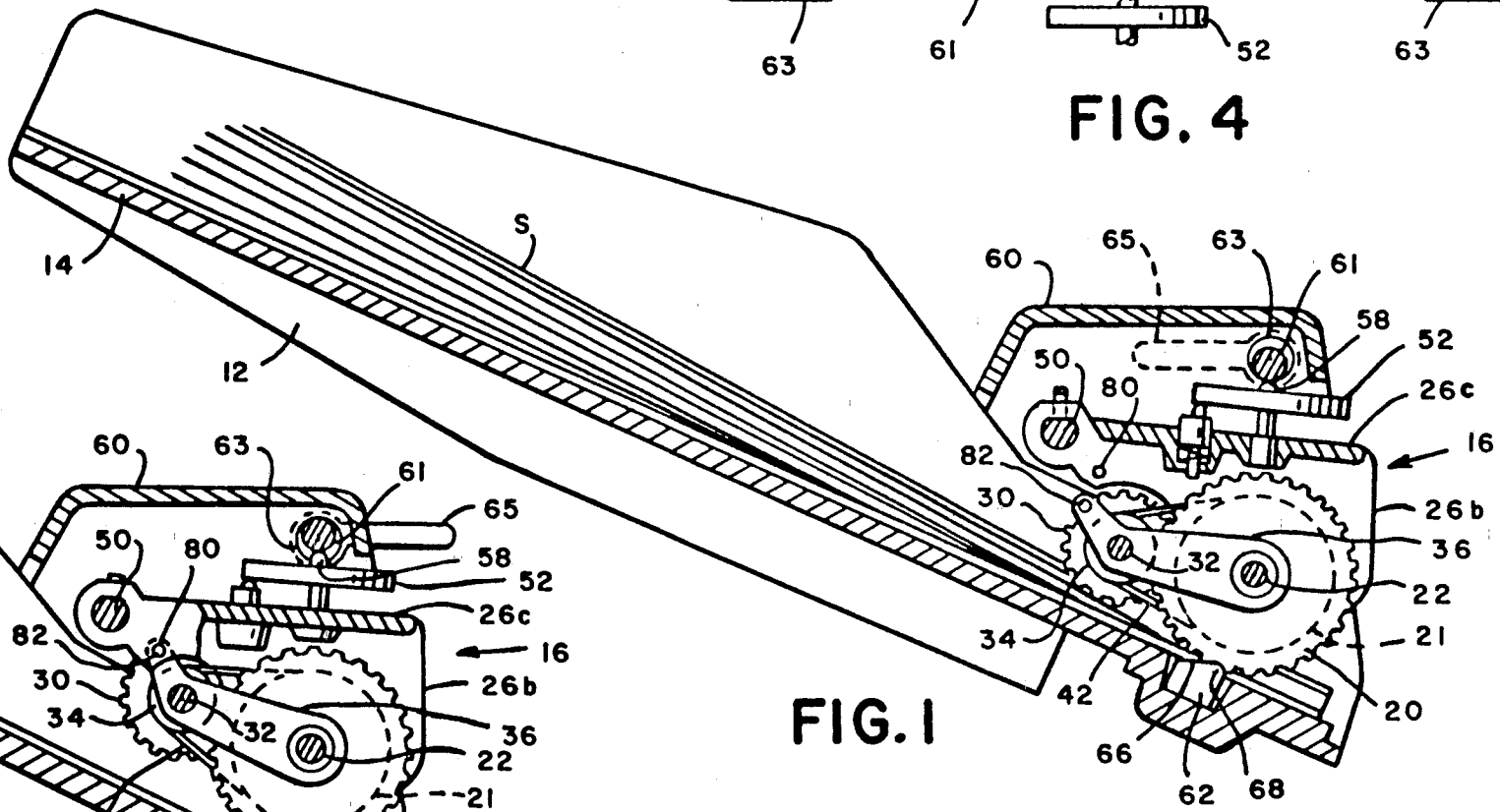
FIG. 1 is a side view of the feeder incorporating the preferred embodiment of the present invention with the separator wheel assembly in an adjusted position for singulating sheets fed from the feed deck.
Figure 2:
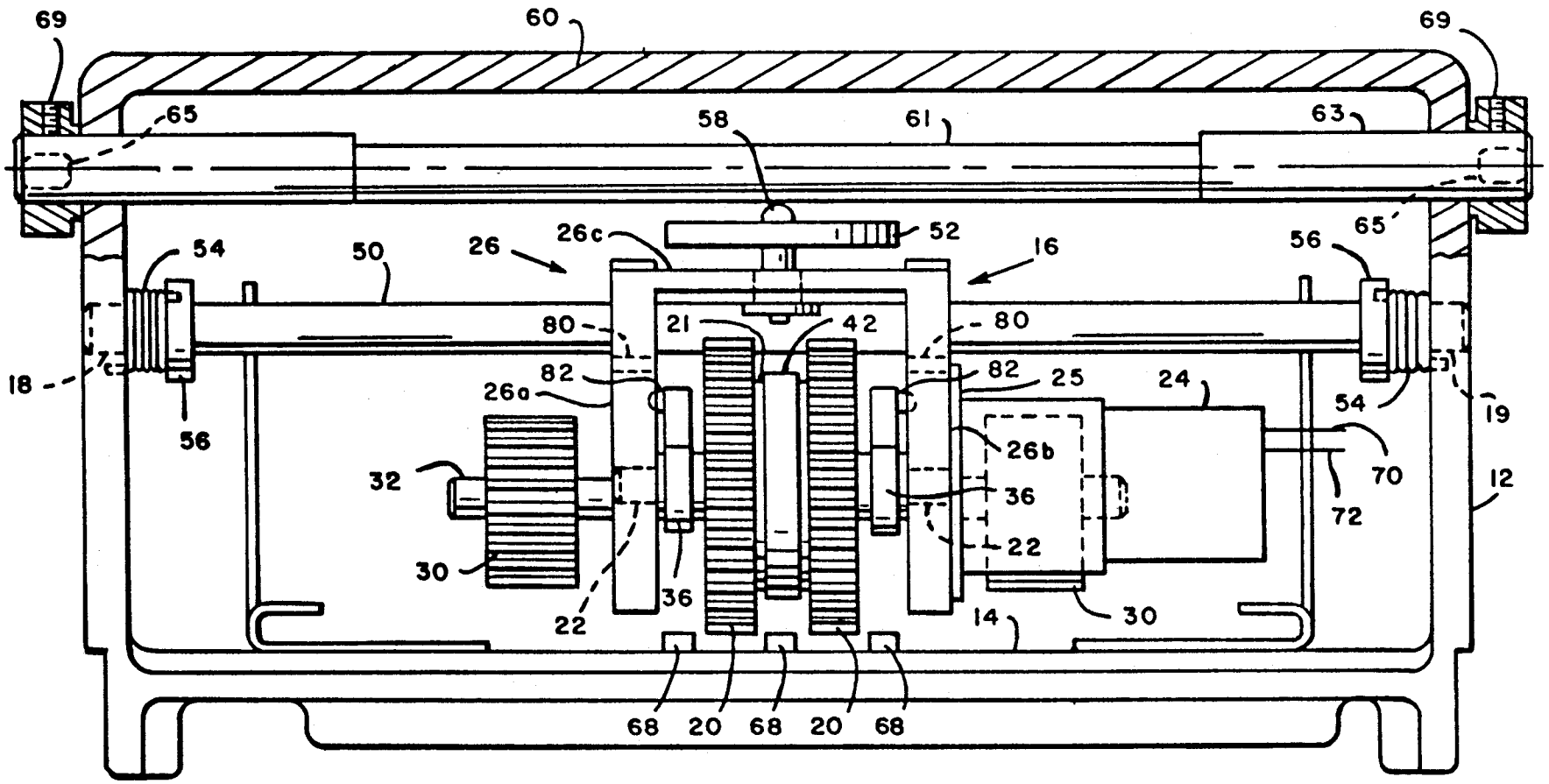
FIG. 2 is a front view of the preferred embodiment of the present invention in the document feeder of FIG. 1.

In FIGS. 1 and 2, there is shown document feeder 10, having document support frame 12. In the preferred embodiment of the present invention, the frame 12 is one piece, molded of a suitable plastic material thereby eliminating the assembly and adjustment of parts required for such typical frames. The frame 12 includes a feed deck 14 on which a supply of sheets or envelopes may be stacked. In accordance with the invention, separator wheel assembly 16, further described below, is pivotally mounted to the frame at 18 and 19.

In the preferred embodiment of the present invention, the separator wheel assembly 16 comprises two separator wheels 20 each mounted to a hub 21. The hub 21 is carried by an output drive shaft 22 of motor 24, which shaft fits through an aperture in the hub 21. The motor 24 is a small DC motor of conventional design, such as DC motor part No. 415A153 manufactured by Globe Motors of Dayton, Ohio. The motor 24 has two electrical leads 70 and 72. In FIG. 2, lead 70 is the positive lead connected to a voltage source and lead 72 is the negative lead connected to a voltage return. The motor 24 is mounted to plate 25 which in turn is mounted to housing 26. The housing 26 is U-shaped, comprising two side panels **26*a* and 26*b* and top panel 26*c*, to provide a symmetrical support for the motor shaft 22 and the separator wheels 20. It has been found that the symmetrical shape of housing 26 provides a means for mounting motor 24 on either side of housing 26, further described below. The motor shaft 22 is suitably journaled through the side panels 26*a* and 26*b*. One-way clutch bearings 28 seated between the aperture in the hub 21 and the motor shaft 22 allow the separator wheels 20 to freely rotate on the shaft 22 in one direction (counter-clockwise as viewed from FIG. 1**) and prevent slippage in the other direction.

One pair of prefeed wheels 30 are mounted on a prefeed shaft 32 which is driven by prefeed hub 34. The shaft 32 is supported on each side of hub 34 by one end of two support arms 36. The other end of each of the support arms 36 is pivotally attached to the respective sides of the aperture in the separator wheel hub 21. Timing belt 42 is used to engage the notched pulley sections of hubs 21 and 34 to drive prefeed wheel hub 34 when the separator wheel hub 21 is directly driven by motor shaft 22. The separator wheels 20, as well as prefeed wheels 30, may be formed of any suitable material having a relatively high coefficient of friction such as urethane. It has been found desirable to employ one pair of prefeed wheels 30 on the prefeed shaft 32 in conjunction with two separator wheels 20, however, other suitable combinations can be used as desired.

The housing 26 is rigidly mounted to a shaft 50 in a known manner, for example, by set screws (not shown). An indexing wheel 52, including a nipple 58 centered on the top of the wheel, is adjustably mounted to the top of the housing 26 in a suitable manner such that indexing wheel 52 is lowered, for example on threads, to the top of the housing 26 when the wheel 52 is turned in one direction and is raised when turned in the other direction. The shaft 50 suitably journaled to the sides of the frame 12 at 18 and 19. The entire separator wheel assembly 16 pivots about the shaft 50 to an adjustment position commensurate for the type of material being fed. A pair of springs 54 and collars 56, are used to bias the shaft 50 and separator wheel assembly 16 in a counter-clockwise direction, as viewed from FIG. 2, such that the nipple 58 rests against eccentric cam 61. Cam 61 is part of eccentric cam shaft 63 which is rotatably mounted to the sides of frame 12. Bridge 60 is rigidly mounted to the frame 12 and positioned above the cam shaft 63 and the separator wheel assembly 16. At each end of cam shaft 63 is lever 65 for rotating cam shaft 63 between its normal or "high-side eccentric" position shown in FIGS. 1 and 2, for feeding individual sheets, and its low side eccentric position, shown in FIGS. 3 and 4, for raising the separator wheel assembly for clearing paper jams and feeding multiple sheets. Each lever 65 is mounted to cam/shaft 63 by set screws 69.

In setting up the bite adjustment between the separator wheels 20 and the stone 62, the separator wheel assembly 16 is lowered or raised by the rotation of the indexing wheel 52. The shaft 50, being predisposed to rotate counterclockwise (as seen in FIG. 1) by springs 54, forces the nipple 58 against the cam 61, which is in its normal position. The underside of the indexing wheel 52 contains a plurality of grooves. A plunger 64 is mounted on the top of the housing 26 and is spring biased against the grooves on the indexing wheel 52 to provide detent action when the index wheel 52 is rotated. The top surface of the indexing wheel 52 has numbers or marks around the perimeter for reference in the adjustment the positioning of separator wheels 20.

The separator stone 62 is adjustably secured to the frame so that the stone 62 can be laterally positioned under the separator wheels. The stone 62 extends through a slot in the frame 12. A shield 66 is formed of a sheet of resilient material such as stainless steel or the like. Adjacent the forward end of the shield 66, a plurality of fingers 68 of the stone 62 extend through feed deck 14. The shield 66 and stone fingers 68 are in fixed spatial relationship to one another. In the preferred embodiment of the present invention, the stone 62 has three fingers to achieve the interference separation with the two separator wheels 20.

In operation, sheets S are stacked on the feed deck 14 of the feeder 10. The motor 24 is energized causing prefeed wheels 30 and separator wheels 20 to rotate. The top sheet of the stack of sheets S is engaged by prefeed wheels 30 and is fed to separator wheels 20 which then feeds the sheet to a transport belt assembly (not shown). As the trailing edge of the sheet passes by the prefeed wheels the next sheet is engaged by the prefeed wheels 30.

Although the prefeed wheels 30 are driven at slower speed than the separator wheels 20, it will be understood by those skilled in the art that when a sheet is engaged by the separator wheels 20 the separator wheels take over the feeding of the sheet, i.e., effectively yanking the sheet from under the prefeed rollers. This is typical for interference type separator assemblies. It will also be understood that when the leading edge of the sheet is engaged by the downstream transport assembly (not shown), the assembly, operating at a suitable speed, will effectively yank the sheet away from the separator wheels 20. The one way clutch bearing 28 allow the separator wheels to rotate freely as the transport assembly, operating at a higher speed, takes control of the sheet.

In U.S. Pat. No. 4,501,417, supra, lateral positioning of a feed wheel and prefeed wheel assembly for handling offset feeding is described. If it is desired to offset the separator wheel assembly 16 in the present invention, the set screws (not shown) used in rigidly mounting housing 26 to shaft 50 are loosened and the assembly 16 can be laterally positioned along shaft 50 as required for the particular offset feeding. As seen in FIG. 2, the length of cam 61 in cam shaft 63 is suitable for the offset positioning of separator wheel assembly 16. It will be seen that in such an arrangement, motor 24 mounted to the separator wheel assembly 16 interferes with the lateral positioning of the separator wheel assembly 16 when certain offset feeding is required. It will be appreciated that, as seen in FIG. 2, the separator wheel assembly 16 can be offset a full range to the left, but only a limited range to the right because of the motor mounted to the assembly 16. The symmetrical shape of the separator wheel assembly allows the motor to be mounted on either side of the assembly. It has also been found that moving the motor to the other side of the separator wheel assembly 16 and reversing the electrical leads 70 and 72 of the motor allows the assembly 16 to be offset the full range to the right of center without effecting the performance or operation of the feeder. It will be understood that reversibly mounting the motor to alternate sides of the assembly is only for allowing full range of offset feed adjustments and does not change the operation or performance of the feeder in any way. It will be further understood that the separator stone 62 must be suitably positioned to cooperate with the separator wheel assembly in the interference separation of the sheets.

Figure 4:
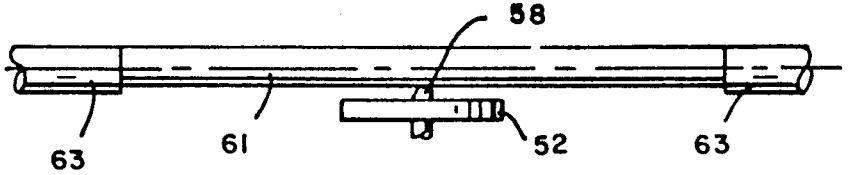
FIG. 4 is a partial front view of the feeder in FIG. 1 showing the cam in its low eccentric position.
Figure 3:
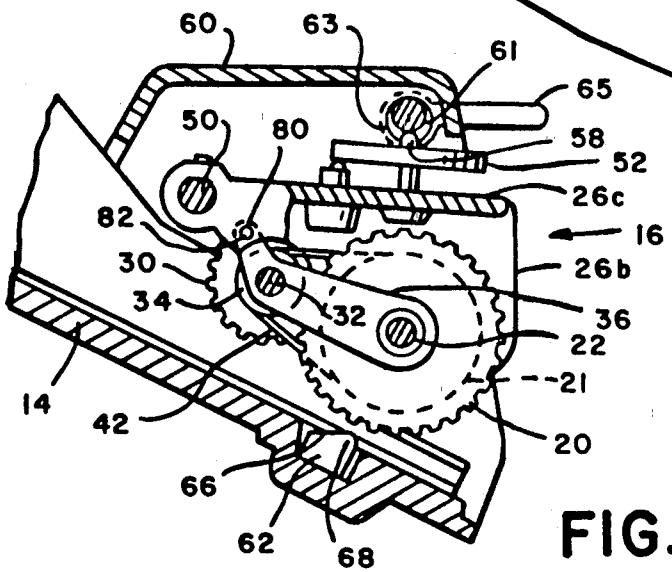
FIG. 3 is a side view of the document feeder of FIG. 1 with the separator wheel assembly in the raised position.

Referring now to FIGS. 3 and 4, when a jam occurs under the separator wheel assembly 16, the levers 65 are rotated 180 degrees causing the cam 61 to rotate to its low side eccentric position. The spring biased separator wheel assembly 16 follows the profile of cam 61 as nipple 58 is urged against cam 61. This causes the separator wheel assembly to rise from its bite adjustment position. The jam can now be cleared without damage to the jammed sheet. Reversing the levers 65 returns the cam 61 is its normal or high side eccentric position, as shown in FIGS. 1 and 2, thereby returning the separator wheel assembly to its bite adjusted position for separating and feeding individual sheets.

It has been found that the preferred embodiment of the present invention provides an additional capability to the feeder which previously was unavailable due to the nature of the interference type separator. When the separator wheel assembly is in the raised position, multiple or single sheets can be manually fed as desired through the feeder 10 for further processing, such as folding and insertion into an envelope downstream of the feeder 10. This procedure is referred to as a "daily mail" feature which allows an operator to process manually multiple sheets and individual sheets, as needed, without affecting the bite adjustment of the separator wheel assembly 16 for feeding sheets stacked on the feed deck 14 when the cam 61 is returned to its normal position.

It has been found that when multiple or single sheets are manually fed with the separator wheel assembly 16 in the raised position, the motor 24 can be energized to drive separator wheels 20 and prefeed wheels 30 to assist in the manual feeding to the transport assembly (not shown). It has also been found that the manual feeding of sheets can be accomplished without energizing motor 24, i.e., by manually feeding the sheets past the separate assembly for transport by the downstream transport assembly.

Referring again to FIG. 3, the prefeed wheels 30 are shown in a raised position when two locking detents 80 situated in the separator wheel housing 26 are engaged by the locking detail 82 in each of the prefeed support arms 36. Each of the locking details 82 can be locked into the corresponding detent 80 by manually lifting the support arms 36 until the locking details 82 lock into the detents 80. The support arms 36 can be manually unlocked when the desired operation is completed. Since the prefeed support arms pivot at separator wheel hub 21 and are free floating, or if desired spring loaded at the prefeed hub end, it will be understood that the prefeed wheels 30 can be raised or left in their normal positions without affecting the jam clearing or daily mail operation.

It has been found that alternative configurations can be used to raise the separator wheel a fixed amount to clear a jam and then return the separator wheel to its adjusted position for singulating sheets. For example, the cam shaft 63 described in the preferred embodiment of the present invention can be replaced by a cam mounted on the separator assembly 16 directly above the nipple 58 of indexing wheel 62 such that when the cam is rotated, the assembly 16 is raised to a suitable height by clearing a paper jam.

Another alternative configuration is a lever or shaft, in place of cam shaft 63, against which separator wheel 16 is biased. The lever can be withdrawn or moved such that the separator assembly 16 raises off the deck with nipple 58 resting against bridge 60. The separator assembly 16 is returned to its adjusted position when the lever or shaft is returned to its previous position.

It will be appreciated by those skilled in the art that there has now been disclosed a novel jam clearing and daily mail device for document feeder. While this invention has been described in conjunction with specific embodiments thereof, many alternatives, modifications and variations will be apparent to those skilled in the art. Accordingly, it is intended to embrace all such alternatives, modifications and variations that follow within the spirit and scope of the appended claims.

What is claimed is:

1. In a document feeder in an inserting machine, the feeder comprising a frame, a feed deck coupled to the frame, a separator assembly for separating and feeding individual documents, the separator assembly including a separator wheel disposed above the feed deck, means for driving the separator wheel, and means for adjustably positioning the separator wheel assembly to a position relative to the feed deck commensurate with the material being fed, the improvement comprising:

leverage means for first raising the separator assembly from an adjusted position to a height suitable for clearing a paper jam and for then returning the separator assembly to said adjusted position, wherein said leverage means includes a cam located above the separator assembly, said separator assembly being biased against said cam.

2. The improvement in accordance with claim 1 wherein said cam is in a high eccentric position when the separator assembly is in said adjusted position, said cam being rotated to a low eccentric position when the separator assembly is in a raised position.

3. The improvement in accordance with claim 2, wherein said cam is part of a rotatable cam shaft, said cam moving between said high eccentric position and said low eccentric position as said cam shaft is rotated.

4. In a document feeder in an inserting machine, the feeder comprising a frame, a feed deck coupled to the frame, and a separator assembly for separating and feeding individual documents, wherein the separator assembly includes a separator wheel disposed above the feed deck, means for driving the separator wheel, and means for adjustably positioning the separator assembly to a position relative to the feed deck commensurate with the material being fed, the improvement comprising:

means for biasing the separator assembly against a cam, said cam located above the separator assembly, wherein the separator assembly is in an adjusted position for singulating and feeding sheets when said cam is in a first position, and wherein the separator assembly, including said driving means, operatively raises to a raised position when said cam is rotated to a second position, whereby the singulating and feeding of individual documents is interrupted when the separator assembly is in said raised position.

5. The improvement in accordance with claim 4 wherein the separator assembly can be returned to said adjusted position by returning said cam to said first position.

6. The improvement in accordance with claim 4 wherein said cam is part of a shaft mounted at each end to a side of the feeder, said shaft including a center eccentric cam portion and said shaft having a lever at each end for rotating said cam portion between said first and second positions.

7. The improvement in accordance with claim 4, wherein the separator assembly further comprises prefeed wheels, said prefeed wheels having the capability of being retracted and locked into a raised position.

8. In a document feeder in an inserting machine, the feeder comprising a frame, a feed deck coupled to the frame, a separator assembly for separating and feeding individual documents, the separator assembly including a separator wheel disposed above the feed deck, means for driving the separator wheel, and means for adjustably positioning the separator assembly to a position relative to the feed deck commensurate with the material being fed, the improvement comprising:

means for biasing the separator assembly against a cam, said cam located above the separator assembly, wherein the separator assembly is in an adjusted position for singulating and feeding sheets when said cam is in a first position, and wherein the separator assembly operatively raises to a raised position when said cam is rotated to a second position, whereby the singulating and feeding of individual documents is interrupted when the separator assembly is in said raised position and wherein the driver means drives the separator wheel when the separator wheel is in the raised position, whereby a plurality of sheets can be fed through the separator assembly.

9. The improvement in accordance with claim 8, wherein said cam portion of said shaft suitably extends along the length of the shaft to accommodate offset feeding adjustments of the separator wheel assembly.

10. The improvement in accordance with claim 8, wherein said driving means comprises a dc motor including a driving shaft coupled to said separator wheel for directly driving said separator wheel.

* * * * *